US009493965B2

(12) United States Patent
Viviano

(10) Patent No.: US 9,493,965 B2
(45) Date of Patent: Nov. 15, 2016

(54) SYMMETRICAL UNI-DIRECTIONAL SINGLE ACTION CENTERED CYLINDER KEYLESS DEADBOLT DOOR LOCK ASSEMBLY FOR RIGHT OR LEFT HAND HUNG DOORS

(71) Applicant: Robert J Viviano, St. Louis, MO (US)

(72) Inventor: Robert J Viviano, St. Louis, MO (US)

(73) Assignee: Easy Lock, LLC., St. Louis, MO (US)

( * ) Notice: Subject to any disclaimer, the term of this patent is extended or adjusted under 35 U.S.C. 154(b) by 0 days.

(21) Appl. No.: 14/756,760

(22) Filed: Oct. 8, 2015

(65) Prior Publication Data

US 2016/0040454 A1 Feb. 11, 2016

Related U.S. Application Data

(63) Continuation-in-part of application No. 13/385,915, filed on Mar. 14, 2012, now abandoned.

(60) Provisional application No. 61/465,208, filed on Mar. 16, 2011.

(51) Int. Cl.

| | |
|---|---|
| ***E05B 65/06*** | (2006.01) |
| ***E05B 33/00*** | (2006.01) |
| ***E05B 63/00*** | (2006.01) |
| ***E05B 63/04*** | (2006.01) |
| ***E05B 13/00*** | (2006.01) |

(52) U.S. Cl.

CPC ..... *E05B 33/00* (2013.01); *E05B 13/005* (2013.01); *E05B 63/0017* (2013.01); *E05B 63/04* (2013.01); *Y10T 70/5319* (2015.04)

(58) Field of Classification Search

CPC .. E05B 13/005; E05B 63/04; E05B 63/0017; E05B 33/00; E05B 63/042; E05B 63/044; Y10T 70/5319

USPC ..... 70/190, 379 R, 379 A, 380, 381, 134, 70/461, 462, DIG. 39; 292/244, DIG. 60

See application file for complete search history.

(56) References Cited

U.S. PATENT DOCUMENTS

| | | | |
|---|---|---|---|
| 3,593,548 | A | 7/1971 | Kendrick |
| 3,719,821 | A | 3/1973 | Foreman |
| 3,992,908 | A | 11/1976 | Crepinsek |
| 4,047,408 | A | 9/1977 | Johns et al. |
| 4,662,665 | A | 5/1987 | Lin |
| 4,854,143 | A | 8/1989 | Corder et al. |
| 4,895,404 | A | 1/1990 | Toledano |
| 4,921,290 | A | 5/1990 | Dietrich |
| 4,950,008 | A | 8/1990 | Fang |

(Continued)

FOREIGN PATENT DOCUMENTS

| | | |
|---|---|---|
| WO | WO 2007/001311 | 1/2007 |

*Primary Examiner* — Lloyd Gall

(74) *Attorney, Agent, or Firm* — Paul M Denk

(57) ABSTRACT

A door lock assembly operates a deadbolt between unlocked and locked positions. It includes an actuator, a ring, and a spring member. The actuator includes an integral arm, that extends inwardly, to the center of the ring, and the arm has a cam provided upon the center axis, and receives the torque blade from center key cylinder. In the preferred embodiment, when the ring is turned in a clockwise direction, it locks the deadbolt of the latch bolt assembly, by shifting it to a locking position, and all of this can be achieved because the key cylinder is on a center axis, and the axis of the latch bolt assembly and deadbolt intersects that same center axis in their operation.

15 Claims, 8 Drawing Sheets

(56) References Cited

U.S. PATENT DOCUMENTS

| | | | |
|---|---|---|---|
| 4,957,315 | A | 9/1990 | Lin |
| 5,010,749 | A | 4/1991 | Lin |
| 5,150,592 | A | 9/1992 | Lin |
| 5,186,030 | A | 2/1993 | Lin |
| 5,551,264 | A | 9/1996 | Fann et al. |
| 5,797,286 | A | 8/1998 | Armstrong |
| 5,813,261 | A | 9/1998 | Boehlow |
| 6,318,769 | B1 | 11/2001 | Kang |
| 6,601,420 | B1 | 8/2003 | Boehlow |
| 6,626,018 | B2 | 9/2003 | Eller et al. |
| 6,735,993 | B2 | 5/2004 | Eller et al. |
| 6,860,129 | B2 | 3/2005 | Eller et al. |
| RE40,193 | E | 4/2008 | Boehlow |
| 7,389,661 | B2 | 6/2008 | Viviano et al. |
| 8,360,482 | B2 | 1/2013 | Viviano |
| 2006/0243008 | A1 | 11/2006 | Etlicher |
| 2007/0199354 | A1* | 8/2007 | Ellis ..... E05B 63/0017 70/134 |
| 2009/0071204 | A1 | 3/2009 | Garza et al. |
| 2010/0107707 | A1 | 5/2010 | Viviano |
| 2011/0016938 | A1 | 1/2011 | Chi |
| 2012/0234059 | A1 | 9/2012 | Viviano |

* cited by examiner

SYMMETRICAL UNI-DIRECTIONAL SINGLE ACTION CENTERED CYLINDER KEYLESS DEADBOLT DOOR LOCK ASSEMBLY FOR RIGHT OR LEFT HAND HUNG DOORS

CROSS REFERENCE TO RELATED APPLICATION

This application is a continuation-in-part of the patent application having Ser. No. 13/385,915, filed on Mar. 14, 2012, which application is a non provisional of the provisional application having Ser. No. 61/465,208, filed on Mar. 16, 2011. This application is related to and claims the benefit of the subject matter of U.S. Pat. Nos. 7,389,661, 6,601,420, and published application No. 2010/0107707A1 having Ser. No. 11/993,179 and filing date of Jan. 15, 2010, and which application, as a National Stage filing, derives and claims priority from PCT/US2005/023574 having an international filing date of Jun. 24, 2005, published as International Publication No. WO 2007/001311 A1. All of these patents and applications are incorporated herein by reference.

FIELD OF THE INVENTION

This invention relates to deadbolt and deadbolt latch as a complete unit for door lock assemblies, and more specifically, pertains to a symmetrical centered cylinder deadbolt door lock assembly for use in combination with a symmetrical centered deadbolt latch means, and which latch can be inverted 180° to provide for its application to either a right hand or a left hand hinged door without any further disassembly of any other components of the deadbolt or deadbolt latch locks.

BACKGROUND OF THE INVENTION

Deadbolt door lock assemblies are commonly installed on entry doors of commercial and residential buildings to lock the doors closed and to provide increased security against unwanted entry. In such lock assemblies, a deadbolt is selectively positioned between an unlocked position and a locked position. In the unlocked position, the deadbolt latch is recessed flush into the door, allowing the door to open. In the locked position, the deadbolt latch is extended into the door jamb, preventing the door from opening. In the locked position, the deadbolt latch extends out from the door for disposition within an opposing door frame jamb (when the door is closed), thereby securely locking the door.

Single cylinder and double cylinder deadbolt lock assemblies may be used. Both generally include an oscillating crank to actuate the deadbolt between the unlocked and locked positions. In the single cylinder assembly, a torque blade connects the crank to a thumb turn mounted on the inside facing surface of the door (e.g., accessible from within the building) and to a lock cylinder accessible from the outside surface of the door. The thumb turn can be manually turned or a key can be used to operate the lock cylinder to rotate the torque blade and actuate the deadbolt between its unlocked and locked positions.

While it is known that deadbolt door locks provide improved security, people often do not use them after closing the door from outside because it requires finding the correct key to operate the lock cylinder. To remedy this, some dead-bolt lock assemblies allow keyless locking operation from outside the door to lock the deadbolt. Examples are disclosed in U.S. Pat. No. 3,593,548 (Kendrick), U.S. Pat. No. 5,010,749 (Lin), U.S. Pat. No. 5,150,592 (Lin), U.S. Pat. No. 5,186,030 (Lin), and U.S. Pat. No. 5,797,286 (Armstrong). These deadbolt door lock assemblies typically include a ring surrounding the lock cylinder in operative connection with the torque blade to actuate the deadbolt to its locked position without having to use a key.

The main drawback to these prior patents is pre-installation reconfigurations, the need for extra interchangeable parts and extra latches because of the non-centered design of their deadbolts. Still another problem is for the person remembering the correct direction to turn the locking ring either to the right or left when locking the door. Further, on the typical home, one door will be a left hand door and another will be a right hand door. The person will need to remember which deadbolt to turn to the right or to the left to lock their door. This can cause a door that is thought to have been locked that is in fact unlocked. Another drawback of these prior deadbolt door lock assemblies is that they are susceptible to binding or jamming during subsequent unlocking of the deadbolt.

All prior keyless deadbolts have been designed to fit existing deadbolt latches. Thus, they could not be converted between left hand hung doors and right hand hung doors. In this invention, this is the first time a deadbolt and deadbolt latch assembly has been designed to not require any reconfiguration of the deadbolt, and its latch, or require any reassembly of its components, to make it work on left hand or right hand hung doors.

In particular, the ring tends to interfere with the rotation of the torque blade back to a position corresponding to the unlocked position of the deadbolt. In addition, the force necessary to overcome binding of the lock accelerates wear of the internal mechanisms of the assembly. Another disadvantage of some prior keyless dead-bolt lock devices is that projection of the deadbolt may be dependent on the rotational speed imparted by the user to the ring. In such a design, the deadbolt may not fully project to its locked position, leaving the lock easily retracted without a key.

These drawbacks of these prior deadbolt door lock assemblies can cause binding or jamming during subsequent locking and unlocking of the deadbolt. In particular, the ring can interfere with the rotation of the biased torque blade back to a position corresponding to the unlocked position of the deadbolt. And, the force necessary to overcome binding of the lock accelerates wear of the internal mechanisms of the assembly. Some prior keyless deadbolt lock devices left the projection of the deadbolt dependent on the rotational speed imparted by the user to the ring. As stated, the deadbolt may not fully project to its locked position, leaving the lock easily retracted without a key.

No other keyless deadbolt product has the convenience of a simple turn to the right, for either a right hand or left hand door. Plus there may be the possible use of a start and stop mark on the deadbolt to confirm that you have turned the lock to the fully locked position. It is also the simple turn to the right that is both natural and not confusing to the user. As to, do I turn this lock to the right or left to lock my door. Further there is no reconfiguration when installing the single symmetric action centered keyless deadbolt. Further, as in past patents, it was up to the installer to make sure all pre-configurations were done to make sure the deadbolt would work correctly after installation. This is a far superior new design that eliminates the steps for pre-configuration of the deadbolt needed for any installation. Only in the positioning of the deadbolt latch with a clear simple left hand or right hand stamped into the body for indication of installing the deadbolt on either a right hand or left hand door.

Obviously, though, this lock assembly could also be preassembled during manufacturing for counterclockwise turning to attain a locking of the door.

To this end, co-assigned U.S. Pat. Nos. 5,813,261, 6,601,420, 7,389,661 and RE40193, the entire disclosures of which are incorporated herein by reference, all disclose keyless deadbolt door lock assemblies that inhibit binding upon unlocking of the deadbolt. In particular, the keyless ring is used to actuate the torque blade to move the deadbolt to its locked position, and is then returned to its initial position by a return spring biasing member so that the ring cannot interfere with subsequent movement of the torque blade (e.g., by using a key) back to the unlocked position of the deadbolt.

However, the lock assemblies disclosed in these references in the past are generally usable on only a left hand door or a right hand door. Thus, two different models must be made available (one for use with a left hand door and one for use with a right hand door). Alternatively, the disclosed lock assembly may be disassembled, substantially re-configured and reassembled to switch from use on a left hand door or to use on a right hand door (or vise versa).

There is a need, therefore, for a symmetrical uni-directional, centered cylinder, single action, right turn only keyless deadbolt with deadbolt latch door lock assembly which is operable on either a left hand door or a right hand door with no reconfiguration, and is substantially less susceptible to binding during unlocking of its deadbolt.

SUMMARY OF THE INVENTION

This invention contemplates the formation a symmetrical uni-directional single action centered cylinder keyless deadbolt with deadbolt latch door lock assembly, wherein in the preferred embodiment, its locking ring is exposed to the user and can be turned in one direction, for locking the door, regardless whether the deadbolt is applied to a left hand door, or right hand door, in its installation.

The invention in the preferred embodiment is directed toward a deadbolt door lock assembly for simple uni-directional turn to the right, or clockwise, in a keyless operation of the deadbolt from an unlocked position to a locked position of its deadbolt. In one aspect of the invention, the assembly generally comprises an actuator, a ring, an actuator contact mechanism, a biasing member, and a backstop. The actuator is operatively connected to the dead-bolt and has a centered rotation axis. This centered axis is essential to the convenient installation, use, and operation of the lock assembly. The actuator is rotatable only to the right about its rotational axis from an unlocked position corresponding to the unlocked position of the deadbolt to a locked position corresponding to the locked position of the deadbolt. The ring of the assembly is rotatable relative to the actuator from an initial position to a rotated position, and the actuator contact mechanism is operatively connected to the ring for conjoint rotation. The actuator contact mechanism is configured and arranged for contact with the actuator in the unlocked position of the actuator. When the ring rotates from its initial position only to the right towards its rotated position, the actuator contact mechanism rotates therewith and rotates the actuator from its unlocked position to its locked position. In the locked position of the actuator, the biasing member urges the actuator contact mechanism to interlock with the actuator. This operation of the lock assembly to lock the deadbolt can take place in this embodiment, only in a clockwise operating mode. But, it is possible that the keyless operating of the deadbolt could also be prefabricated during assembly to function within the spirit of this invention by turning of its ring, and actuator, in a counterclockwise direction, and to yet function for application to both a right hand and left hand installed door, in its operations. This is due to the centered axis of the ring actuator and the key operations for the door, regardless if it is a right or left hand hung door.

In a further aspect of this invention, a deadbolt and deadbolt latch door lock assembly for operation of a deadbolt between an unlocked position and a locked position of the deadbolt generally comprises a lock cylinder, a torque blade, a locator, at least one mounting screw, and a stabilizing bridge. The torque blade is operatively connected to the lock cylinder and extends longitudinally therefrom. The torque blade is also operatively connected to the deadbolt whereby the lock cylinder can operate to move the deadbolt latching between its unlocked and locked positions. The locator locates the lock assembly on a door, and the mounting screw mounts the lock assembly onto the door. The stabilizing bridge has openings corresponding to the mounting screws such that screws extend through the stabilizing bridge upon securing the lock assembly on the door. The stabilizing bridge inhibits rotational movement of the mounting screws in a direction transverse to a longitudinal axis of the mounting screw.

It is, therefore, the principal object of this invention to provide a deadbolt door lock assembly that can be used for simple uni-directional turning of a keyless operation of a deadbolt, from an unlocked to a locked position, regardless weather it is applied to a right hand or a left hand assembled door.

Another object of this invention is to provide a ring assembly that is rotatable relative to its actuator from an initial position to a rotated position, usually in the clockwise operating mode, to provide locking of the deadbolt, regardless whether the deadbolt is applied to a right hand or left hand assembled door.

Still another object of this invention is to provide a locking mechanism for a door assembly, where it's key entrance and actuators or generally provided for centered rotation, to provide for movement of its deadbolt into a locking position, regardless whether the deadbolt is applied to a right hand or left hand assembled door.

Another object of this invention is to provide a locking mechanism wherein its actuating ring can also lock its deadbolt latch by turning in a counter clockwise position, depending upon its preconfigured assembly when manufactured.

Still another object of this invention is to provide a deadbolt door lock assembly wherein the deadbolt latch means is simply pivoted or inverted, as when it is shifted for usage from a right hand door, to a left hand door installation, approximately 180°, and this is due to the centered location of its lock cylinder within the assembly.

These and other objects may become more apparent to those skilled in the art upon review of the summary of the invention as provided herein, and upon undertaking a study of the description of its preferred embodiment, in view of the drawings.

BRIEF DESCRIPTION OF THE DRAWINGS

In referring to the drawings.

Corresponding reference characters indicate corresponding parts throughout the various views of the invention illustrated in the drawings.

DESCRIPTION OF THE PREFERRED EMBODIMENT

Figure 1:
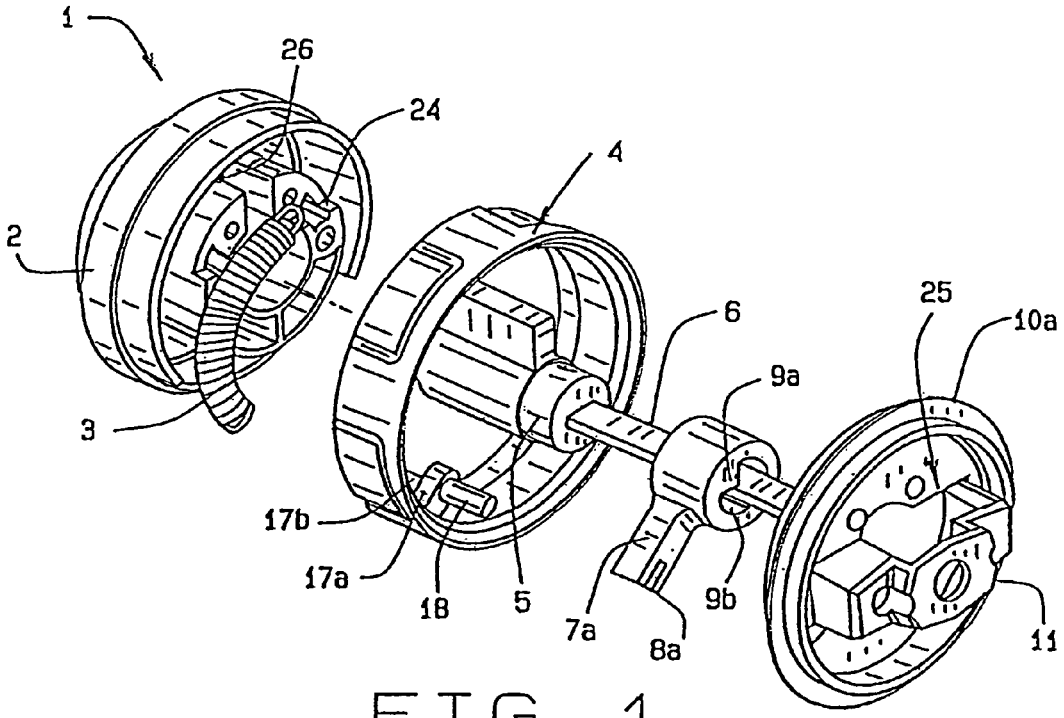
FIG. 1 is a perspective exploded view of the keyless deadbolt lock assembly, with the latch removed.

Reference Characters and Identified Parts of the Invention

1—The single action in a clockwise direction for locking the door lock assembly.
2—Lock faceplate
3—Extension spring
4—Single action right turn clockwise only locking ring
5—Key cylinder
6—Key cylinder torque blade
7*a*—Actuator
8—Actuator forked end
9*a*—Actuator single action activation cam
10*a*—Locator
11—Locator bridge
11*a*—Apertures
12—Centered located cylinder key hole lock
13—Inside bell
14—Lock face
17*a*—Ring post for holding 17*b* and 18
18—Post on ring to interlock with actuator forked end 8*a*
19—New unique fully centered cylinder and deadbolt latch allowing for single action right turns locking
20—Left hand door
21—Deadbolt
22—Latch faceplate
22*a*—Door edge
23—In swing left hand door
24—Lock body foundation interlock
25—Locator interlock
26—Spring post for extension spring
27—Center line of dead bolt latch
28—Dead bolt latch setup for left hand door in-swing
29—Dead bolt latch setup for right Hand door in-swing
30—Latch bolt assembly
31*a*—Latch operator
33—Integral back end
34—Cylindrical shaped frame halve
35—Cylindrical shaped frame halve
36—Latch driving mechanism
56—Bolt casing
60—Hollow tube
72—Spring
76—Pin
88—Rear flat plate
96—Centrally aligned openings
106—Leaf Spring The door lock assembly of this invention is generally shown overall in FIGS. 1, 2, 10, 12, and 13, and generally is identified as the lock assembly 1. As noted in FIG. 1, it provides a perspective view of the uni-directional clockwise only right turn keyless deadbolt lock assembly 1 of this invention. As shown in the drawing, therein is disclosed the ring assembly 4 which in this particular embodiment, will turn in a clockwise manner to lock the door, by engagement of its post 17*a* and with the pin 17*b* , that is attached with or as in FIGS. 10, 12, and 13 has a combined ring and actuator that omits the bridge, the spring 3 and which is useful for turning of its finger 18 operatively associated with the ring 4, that is applied for activating the keyless deadbolt lock manually, without the use of a key. Arranged somewhat forwardly of the ring 4 is the lock faceplate 2 which normally is identified as an end plate, that has connected with it the extension spring 3, which tends to bias the ring 4 back into its inoperative position, once the door latch has been locked. Obviously, the tension spring 3 may also comprise a compression spring, a leaf spring, a spiral spring, or any other spring, which could operate just as effectively by connection with the spring post 26, of the said external plate 2, with the opposite end of the spring 3 connecting with the said post 17*b* , mounted upon the ring 4.

Figure 1A:
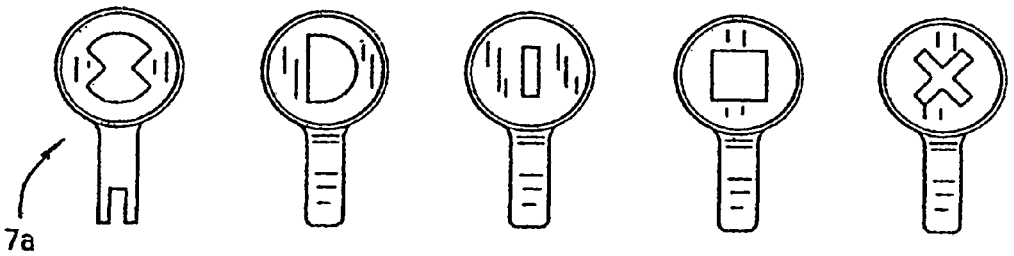
FIG. 1*a* shows the various shapes for the apertures that extend through the actuator and accommodate a similarly shaped torque blade there through during assembly of the locking mechanism.
Figure 6:
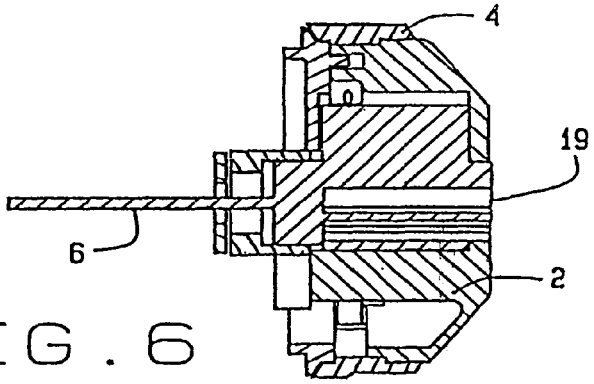
FIG. 6 is a partial cross-sectional view of the deadbolt lock assembly, showing its extended torque blade.

The interlock 24 cooperates with the locator 10*a*, and they attach together through usage of the assembly screws that fit thru the aligned apertures of the said locator, and the lock faceplate 2. This is when the assembly is affixed to the opening provided through the door, for installation of this deadbolt lock assembly. The extension spring 3 is used to return the ring 4 to its rest position, as aforesaid, in preparation for the next locking engagement. The key cylinder torque blade 6 is configured for different embodiments, and can be the flat blade as shown in FIG. 1, or it can undertake other shapes, and co-operate with the single action actuation cam 9*a*, depending upon the configuration of the blade 6 (see FIG. 6). Thus, the shape of the blade, and the type of aperture provided through the activation cam 9*a*, determines the structural method for locking of the deadbolt latch, into the door jamb, as the ring 4 is turned as, in the preferred embodiment, in a clockwise direction. See FIG. 1*a* for cam apertures configuration. The actuator 7*a* has a bifurcated end, as noted at 8*a*, and which is designed for riding upon the post 18, for turning of the deadbolt latch into its door locking position, upon turning of the ring 4 of the lock assembly, during usage. The locator 10*a* serves a variety of purposes, generally as defined in my prior identified patents, and includes the lock body foundation interlock 24, that is designed to stabilize and secure together all components of the complete deadbolt assembly with bolts, with the locator bridge 11, and holds the actuator 7*a* in place to insure consistent operation of the lock, and its deadbolt latch, during its operation. FIG. 6 shows all of these components assembled together.

Figure 2:
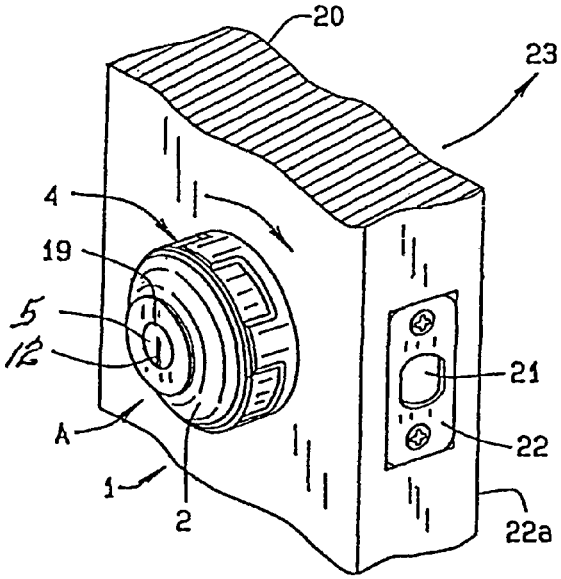
FIG. 2 is a perspective view of the keyless deadbolt and deadbolt latch lock assembly according to a first embodiment of the present invention, showing it installed on an outer surface of an in-swinging left-hand door.

Reference character 12, as noted in FIG. 2, shows the centered key hole for the key cylinder, with its integral key accepting member, which engages centrally within the lock faceplate 2, during assembly. In addition, the actuator 7*a* mounts onto the key cylinder 5, and its torque blade 6, during assembly of the mechanism. See also FIGS. 2 and 13.

In referring to FIG. 2, the keyless deadbolt door lock assembly, according to the first embodiment of the present invention, is generally indicated as being mounted within the door 20. It is illustrated as being installed on an in swinging, left hand door, which generally means that the hinges for the door are provided at the left side of the installed door, and are fixed to the contiguous jamb of the door assembly thereat. Thus, the door 20 is hingedly mounted on the door frame (not shown). In the illustrated embodiment of FIG. 1, in addition to FIG. 2, the lock assembly 1 is mounted on the outside surface of the in swinging door 20 (i.e., the surface that is accessible from the exterior of the building to which the door is mounted). The door 20 opens into the building, e.g., in the direction indicated by the arrow "A", of FIG. 2. It is understood, however, that the lock assembly 1 may be mounted on an inside surface of the door 20, if desirable. It is also to be understood that the lock assembly 1 may be mounted on an outside surface or an inside surface of an out swinging door, which would open in a direction opposite to that as indicated by the arrow "A", without departing from the scope of this invention.

As used herein for the various described embodiments of this invention, it is to be noted that the terms "inner", "inward", "outer" and "outward" without being proceeded by the term "radial" refers to the longitudinal direction of the lock assembly, and more particularly refers to the relative positions of the various components of the lock assembly as viewed from the door looking inward through the lock assembly (e.g., from right to left, as in FIG. 1). The term "radial" and "radially", including the terms "radially inward", "radially inner", "radially outward", and "radially outer" refer to a direction transverse to the longitudinal direction of the lock assembly 1. The above terms otherwise do not require any particular orientation of the lock assembly 1 on the door 20.

What is the essence of this invention is that the lock assembly 1 can be used with out any further structural changes upon either a right hand door, or a left hand door, and all that is required is the inversion of the door latch assembly 30, relative to the lock assembly 1, because the lock assembly 1 has a centered key operational structure, and a centered manipulating torque blade 6, that functions in combination with the ring 4, to furnish a manually self locking door, without the use of a key, and one that can be used on either side of the door, regardless of how it is mounted within the door opening structure. This is due to the orientation of the centering of the key locking mechanism, and the cylinder 5 that can function with the door latch assembly, to attain its movement in either direction, for manual locking purposes, only through a pivotal manipulation of its ring 4, during usage. The only manipulation required is to pivot the latch assembly 30 upon the torque blade approximately 180° during reassembly.

The door lock assembly 1 is operatively connected to a deadbolt latch apparatus, as to be subsequently described, and as indicated generally being installed on the door, having a deadbolt 21, as can be noted in FIG. 2. This deadbolt 21 is movable between an unlocked position, and a locked position, simply through the turning of the lock assembly ring 4, in this embodiment, in a clockwise direction. In the unlocked position, as shown in FIG. 1, and as noted in FIG. 2, in addition to FIGS. 4 through 6, the deadbolt 21 is recessed flush into the free side 22 of the door plate, of the door 22*a* and is arranged flush with its plate 22 on the openable side of the door as can be noted. In the locked position, the deadbolt 21 extends out from the surface of the door 20, and its plate 22, and into the contiguous or opposing door jamb, of the door frame (not shown) to lock the door closed.

Figure 7:
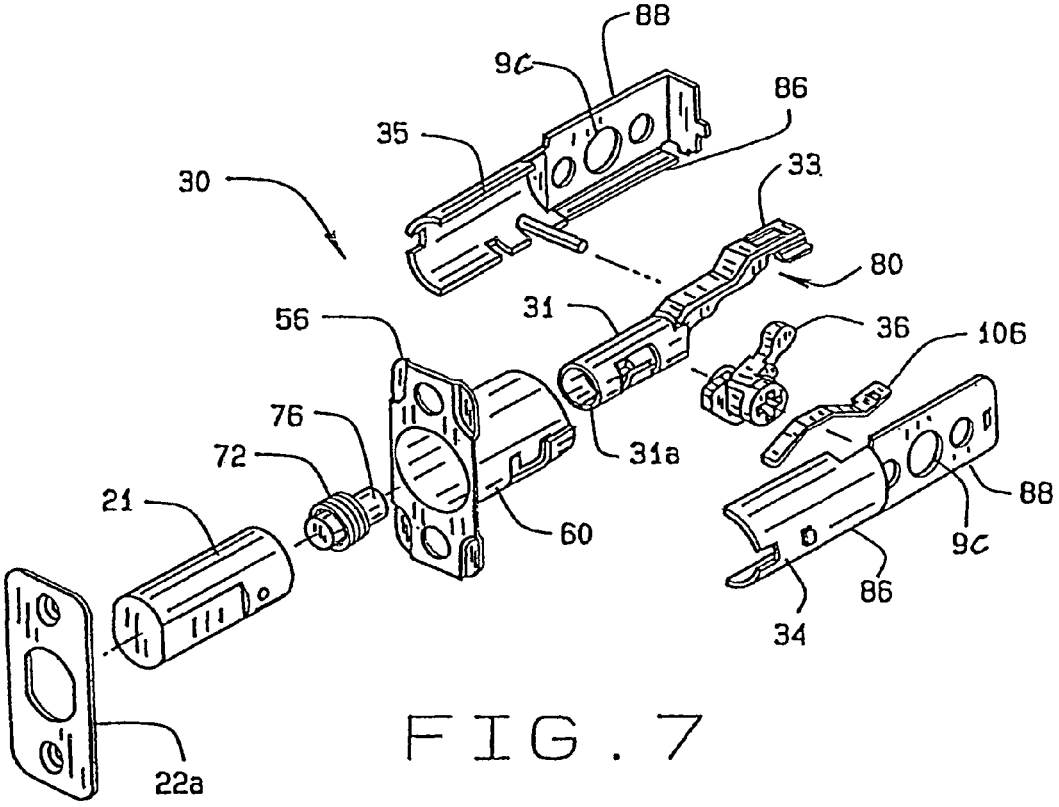
FIG. 7 is an exploded view of the symmetric centerline dead bolt latch assembly for moving its deadbolt into a locking position.

With particular reference to FIG. 7, the deadbolt apparatus comprises a deadbolt housing with its deadbolt 21, and includes a suitable mechanism (e.g., and oscillating crank) for moving the deadbolt relative to the door 20, between its unlocked and locked positions. This can be done either with the use of a key, or by simply turning the ring 4, of the lock assembly, in the manner as previously described. The construction and operation of the deadbolt latch apparatus is known in the art, and will be briefly reviewed with regard to the embodiments of this invention as shown in FIGS. 8*a* and 8*b*, in addition to FIGS. 7 and 9.

Figure 8A:
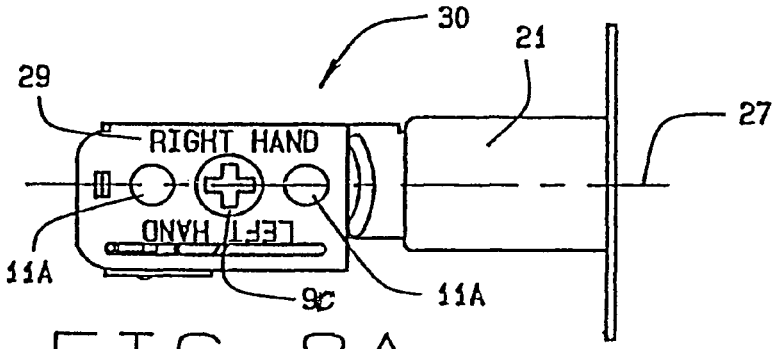
FIG. 8*a* is a basic inside side view of the symmetric centerline deadbolt latch with centered line assembly apertures and center line torque blade interlock hole for the key cylinder for a right hand door installation.
Figure 8B:
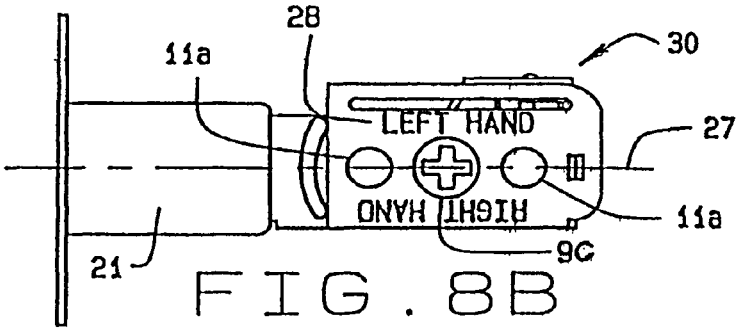
FIG. 8*b* is the basic inside side view of the symmetric centerline deadbolt latch with centered line assembly apertures and center line torque blade interlock hole for the key cylinder for a left hand installed door.

The symmetric uni-directional clockwise direction of movement of the ring 4, as noted in FIG. 2, and as shown by its direction of pivot through the shown arrow is mounted onto the lock faceplate 2, and has the "fully centered" cylinder key hole lock 12, that allows for the single action for right turn only for manipulation of the keyless deadbolt latching mechanism, generally as illustrated in FIG. 7, and as depicted for versatile usage in FIGS. 8A and 8B. The cylinder key hole lock 12 is centered within the faceplate 2 of the lock, and has its key entry provided at 5, and which is aligned with the center arranged tab or torque blade 6 of the lock mechanism, and with its key cylinder 5. Thus, with the central alignment of all of these features of the locking mechanism, including the key hole lock receptive cylinder 12, and its alignment with the key cylinder 5, and the integral blade 6, it can be seen that not only can the door be easily locked, through manipulation of its manual turning ring 4, but the latch mechanism, operatively associated therewith, can move a deadbolt either to the right, when hung upon a left hand door, or can move an inverted latch to the left, when the lock assembly is applied to a right hand mounted door, in its installation.

Figure 3:
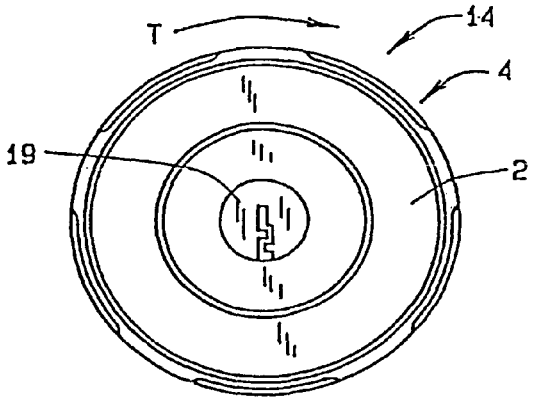
FIG. 3 is a front view of the right turn single action keyless deadbolt lock assembly of this invention, showing its symmetric centered cylinder.

As can be seen in FIG. 3, which is a front faceplate view of the clockwise keyless deadbolt assembly 1, a single action clockwise turning T direction for the ring 4 provides for locking of the door, through manipulation of its latch assembly 30. This can be done simply by turning of its ring 4, to attain movement of the door latch 21, outwardly of its door edge 22*a*, as previously explained. With the ring 4 pivotally mounted onto the body 2, and the fully centered key lock cylinder 19 and centered torque blade 6, it only takes a single action clockwise turn of the ring 4, to attain a shifting of the latch either to the right, or to the left, as depicted in FIGS. 8*a* and 8*b*, after turning the latch 30 an apparently 180° in orientation, as shown. This is attained through the first center alignment of the deadbolt 21 with the various apertures 9*b*, as noted in these figures, and the arrangement of the actuating cam 9*a*, with its blade 6, located fully centered in the structure of the lock assembly, as can be noted. As previously explained, the torque blade 6 of the operative lock assembly is also centered relative to the various lock components, which provides for manual locking of the door, without a key, regardless whether the door latch and bolt mechanism is applied to the right edge, or left edge of the structured door, as noted in these FIGS. 8*a* and 8*b*.

Figure 4:
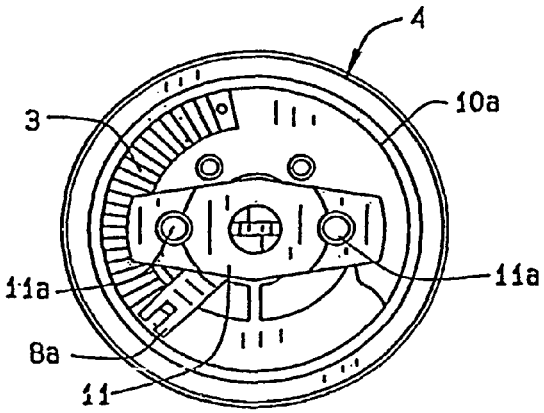
FIG. 4 is a rear view of the keyless deadbolt lock assembly, in its rest position, ready to lock the deadbolt.

FIG. 4 provides a rear face or rear view of the locking mechanism 1, with a ring 4, comprising the keyless deadbolt, in its rest position. In other words, the deadbolt lock can be locked without the use of a key. The spring has pulled the bifurcated end of the actuator 8*a*, back into a steady state condition. The locator 10*a*, with its cut away on the left side, for showing the extension spring 3, being secured through the spring attachment post 18, pulls the spring 3 back to its steady state condition. This is achieved, as previously reviewed, because of the attachment of the post 18 within the bifurcated end 8*a* of the actuator. Also shown is the locator bridge 11 that shows the interlocking of all of these components together, generally through the application of bolts provided through the apertures 11*a* that secure all of these components together, when assembled into the door.

Figure 5:
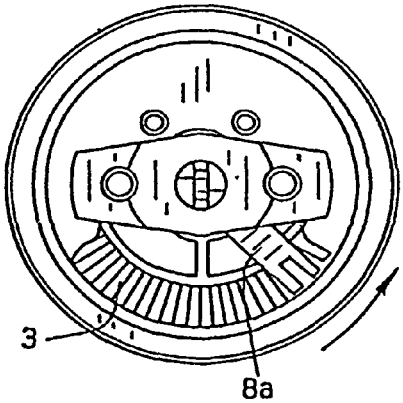
FIG. 5 is a view of the rear surface of the keyless deadbolt lock assembly with the locking ring being turned to the right in the engaged position for locking of the deadbolt.

FIG. 5 illustrates a view of the lock after assembly, where the ring 4 has been turned clockwise, for engagement of the deadbolt lock within the door, against the bias of its spring 3.

FIG. 6 provides a sectional view of the keyless deadbolt lock assembly, and shows how the key latch cylinder 19, the body of the lock 2 faceplate, and its pivotal ring 4 are all conveniently centered within the lock assembly, and in alignment with its torque blade or tab 6, so that when the lock assembly is interconnected with its deadbolt latching means, as in FIGS. 8A and 8B, the latching means may be reversed between its usage for a right hand bolt action, as noted in said FIG. 8A, and showing its deadbolt 21, or how the deadbolt latch may be inverted, to dispose its deadbolt 21 for extension to the left, when mounted for a left hand door operation, as shown in FIG. 8B. What is to be particularly noted, is that the holes 9*c* of the back of the frames 34 and 35 are aligned with the latch cam 36, is also centered, so that it can be inverted for usage for the purposes of this invention, as can also be understood from the FIGS. 8A and 8B are the invertable latch embodiments. You will also note that the apertures 11*a* are provided upon the center line of the deadbolt latch, to assure that the entire assembly can accept the bolts or screws that secure the entire lock assembly to the door, when it is installed, regardless whether it is applied for a right hand operative door or a left hand operating door.

Figure 9:
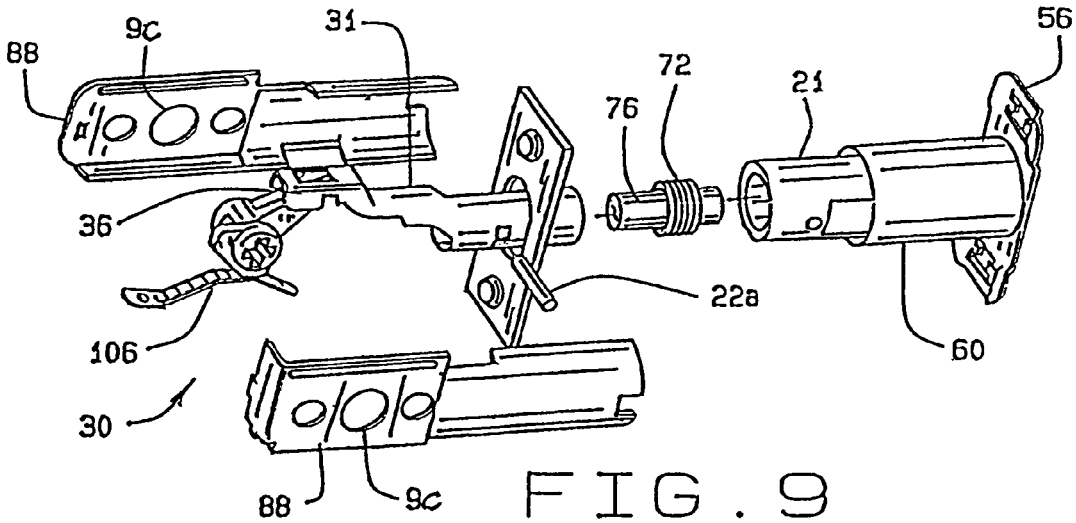
FIG. 9 is another exploded view of a deadbolt latch as used in conjunction with the keyless unidirectional deadbolt lock assembly of this invention.

To provide a brief indication of the type of standard deadbolt lock latching mechanisms that can be used in combination with this invention, FIG. 7, in addition to FIG. 9 shows a standard latch bolt assembly 30, and its various operating components that are engaged by the torque blade 6, extending through the aperture or holes 9*c* , and securing with the latch cam 36, can be seen. In addition, the apertures 11a that accommodate the securement bolts for holding the entire lock assembly in place, installed upon the door, can be also noted, and it can be seen how they are in alignment longitudinally of the latch means, so that the latch can be inverted, when installed on an opposite edge of the door, during its assembly, as desired.

The various elements of the deadbolt lock, and its latch, as shown in FIG. 7, have been previously described in published application No. US2010/0107707 A1, and as stated, are incorporated herein by reference.

Basically the description of the invention as provided herein, shows how a door lock assembly, with a manually operative locking means, without the use of a key, can be operatively connected with a redesigned door latch, so that the lock can be used either on the right edge of the door, of a left side hung door, as noted at 29, or with the inversion of the latch, it can be installed for operation on the left side of the door, for a right hand in swinging door, as noted at 28.

The particular latch mechanism for operating in conjunction with the door lock assemblies, as previous reviewed, is shown in said FIG. 7, and also in FIG. 9, noted at 30. This is an exploded view of the deadbolt and latch bolt assembly. Generally, the integrated structure of this deadbolt latch is described in quite detail in said published application No. U.S.2010/0107707 A1, and the description of its preferred embodiment, in view of its drawings, is incorporated herein by reference, for further clarification for the application of this latch mechanism, and its operation. Essentially, it includes its deadbolt 21, which fits into the cylindrical tube 60, which extends integrally rearwardly from its bolt casing 56. This engages with the latch faceplate 22*a* , when the two are screwed onto in the edge of the door, as can be noted in FIG. 2. The deadbolt 21 fits within the tube 60, when assembled. Likewise, the spring 72, and its associated pin 76, fit within the latch bolt opening, and are pressed therein by means of the latch operator 31. The front of the latch operator, as noted, at 31*a* , presses the spring and its pin within the deadbolt 21. The integral back end 33, of the plate means 80, cooperates with the latch plate sections 88, to provide for urging of the latch bolt between its operative locking position, and its withdrawn unlocked location. The cylindrically shaped frame halves 34 and 35, which when assembled together, form a cylindrical like member, and which locate inside the deadbolt 21, and slide and locate interiorly of the hollow tube 60 of the bolt casing 56. The integral backs of the frame halves 34 and 35, as noted at 88, are formed as flat plates, as noted, and these flat plates embrace the rear section 33 of the latch operator 31 therein, when installed. This rear section 33 is integrally revised and engaged by the tab 36 for shifting of its associated deadbolt 21. As previously reviewed, the centrally aligned openings 9*b* provided through the rear flat plates 88 hold the latch driving mechanism 36 therein, and is held in position by means of the shown leaf spring 106, and its latch driving mechanism 36 has the blade 6 provided therethrough, to furnish a turning of the driving mechanism 36, when forcing the deadbolt 21 between its operative and in-operative positions, whether it be locked exteriorly by means of manipulation of the ring 4, or through the use of a key. In addition, the internal operative mechanism for the door, such as a turn latch 50*a* , also engages with the lock end of the torque blade for turning the latch driving mechanism 36, between its various positions. See FIGS. 12, 13, 8A & 8B, and 14 through 16.

As can be seen, once again in FIGS. 8*a* and 8*b*, the configuration of the latch 30, and more particularly its rear flat plate sections 88, are shown in detail, and it can be seen, once again, how the latch driving mechanism 36 locates within its aligned openings 9*c* , in addition to bolt receiving opening 11*a* , for holding the door lock in place, when assembled and installed. In addition, as can be further seen in these figures, the same door latch can be used for either a right hand door, or left hand door, simply by inverting the same in its installation within the door lock assembly. The arm of the drive 36 fits into the opening of the operator 33 to shift the latch between an open and locked position.

Figure 10:
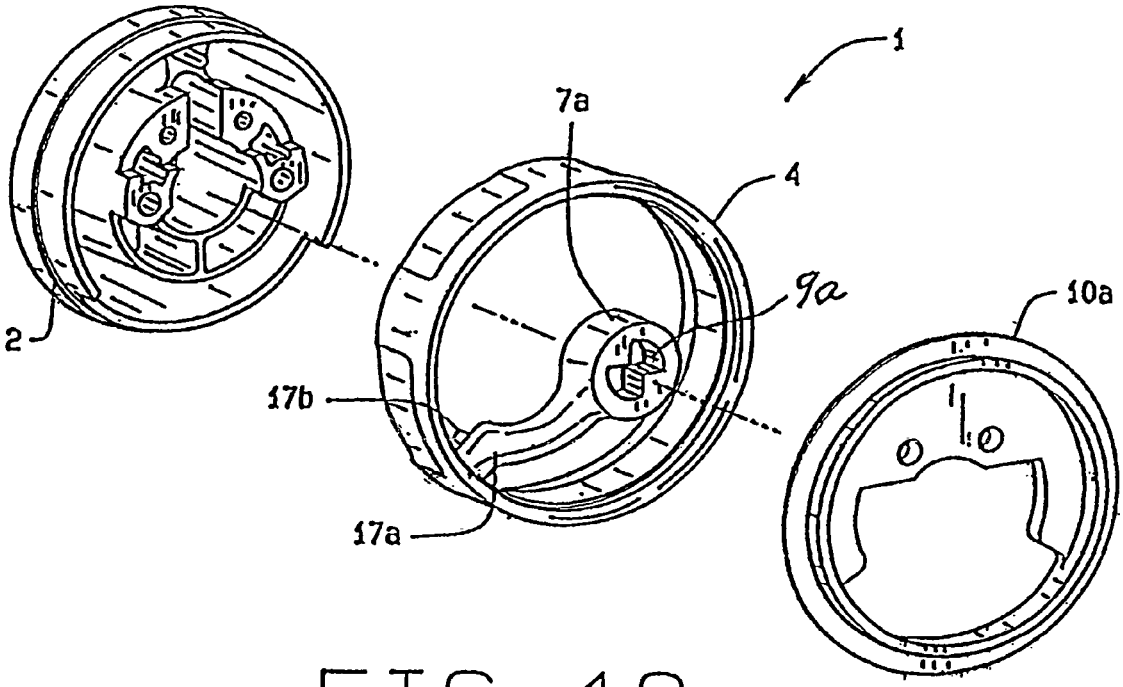
FIG. 10 is an exploded view of the deadbolt lock assembly of this invention, as modified showing how the cast actuator ring and actuator is integrated into one part of the structure of the pivotal ring assembly, and its locator being restructured without the need of the locator bridge.

FIG. 10 shows a modification to the keyless deadbolt lock assembly 1 of this invention. As structured, the assembly includes its lock faceplate 2, which is provided for having pivotally mounted thereon the single action pivotal turning locking ring 4, but in this particular instance, the ring has been modified to provide for an integral cast connection with the actuator 7*a* as can be noted. It can be seen that there is still a ring post 17*a* and 17*b* that will connect with the type of spring 3 as previously reviewed with respect to FIG. 1. And, there is available the locator 10*a* that engages the back edge of the ring 4, when the deadbolt lock is assembled for installation into a door aperture, in the manner as described, and as known in the art. This shows an example as to how the structure of the lock assembly can be modified; certain of its components can be integrated together, so as to reduce the number of independent parts that make up the assembled lock, for usage. Essentially, the actuation cam 9*a* is integrally formed upon the structure of the ring 4. The actuator 7*a* is integrally formed extending inwardly from the ring 4, generally radially inwardly and provides its cam 9*a* located upon the center axis of the key hole lock 12. The ring 4 and the actuator 7*a* are formed as one piece.

Figure 11:
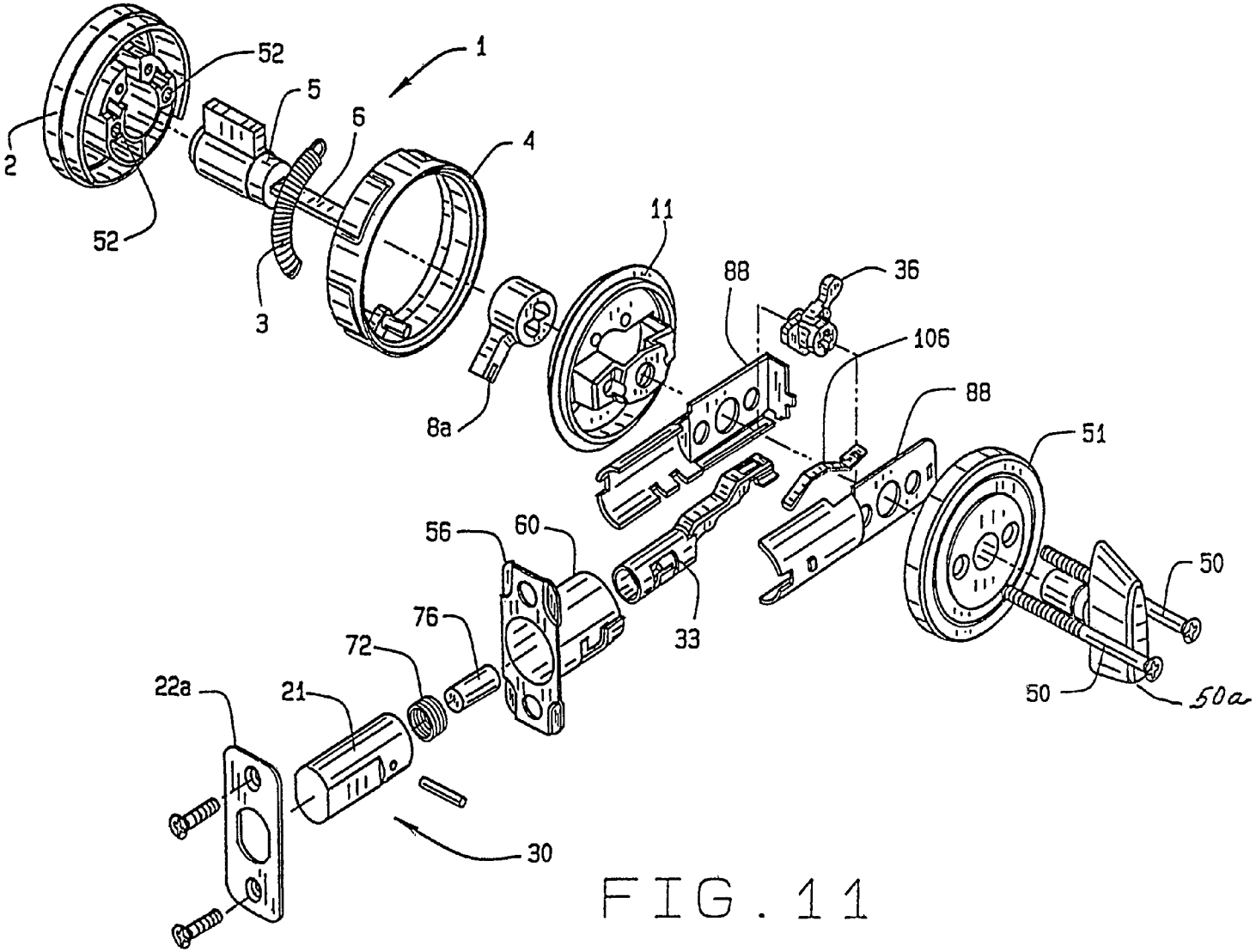
FIG. 11 is an exploded view of the deadbolt and deadbolt latch variety of components that form the keyless deadbolt lock assembly, and its deadbolt latch mechanism, in preparation for installation for a left hand operative door.

FIG. 11 shows an exploded view of the variety of components for both the door locking assembly, and its latching mechanism, generally as previously shown and explained with respect to FIGS. 1 and 7. One can see where the latch mechanism 30 and its various components are integrated into the structure of the locator bridge 11, when it is assembled for either a right hand deadbolt operation, or a left hand deadbolt operation, in the manner as previously reviewed. In addition, the fasteners 50 extend through the variety of apertures of the back plate 51, which is normally arranged interiorly of the door, through the various apertures of the locator bridge 11, through the aligned apertures of the plate sections 88, and screw into the threaded apertures 52 of the lock faceplate 2 of the lock assembly 1.

Figure 12:
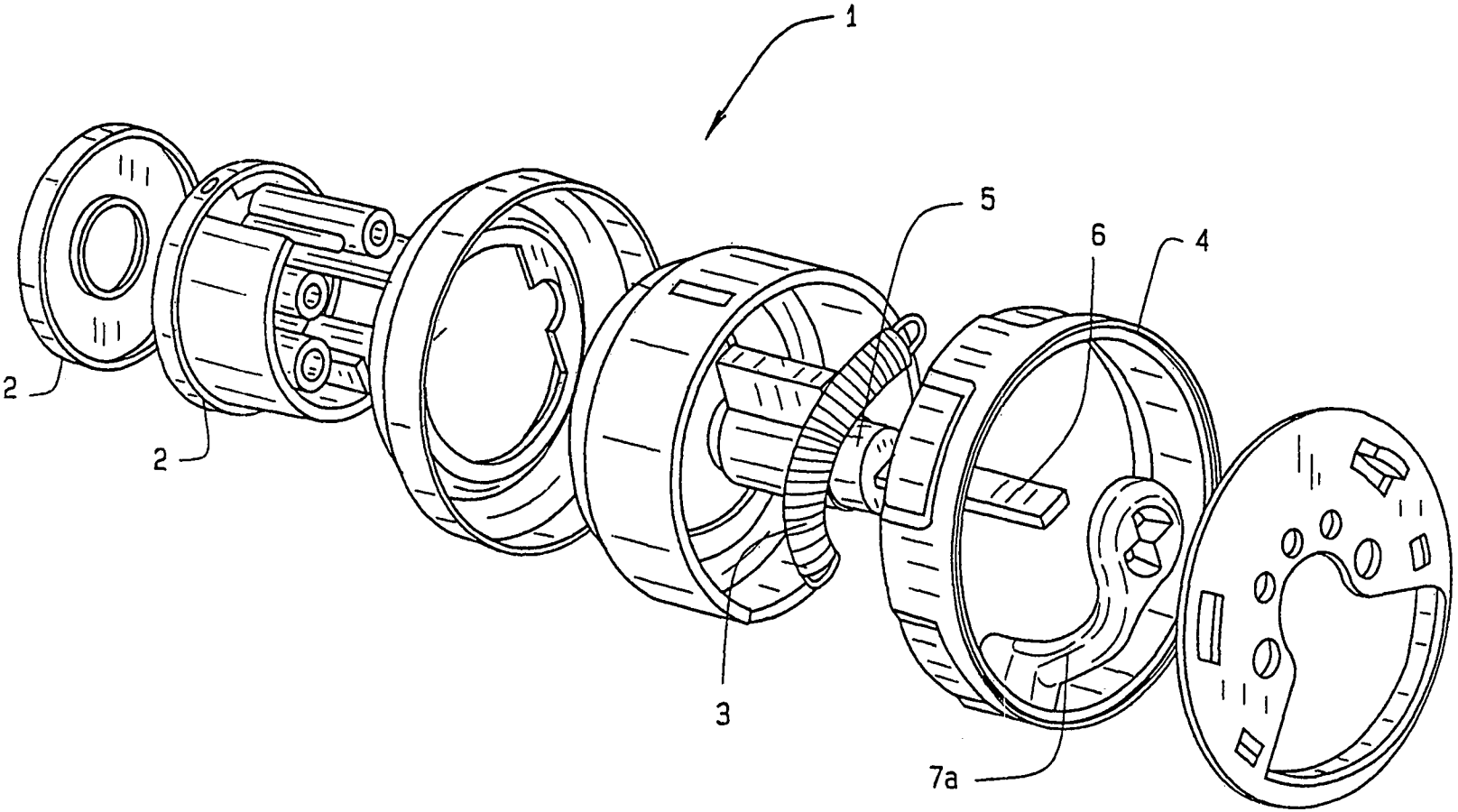
FIG. 12 shows the stamped keyless deadbolt lock assembly, without disclosing its latch mechanism, but incorporating the one part cast actuator ring.

FIG. 12 shows the lock assembly 1 but in this instance, incorporating the locking ring 4 with its integrally structured actuator 7*a*, that may be cast with the ring, when it is formed.

Figure 13:
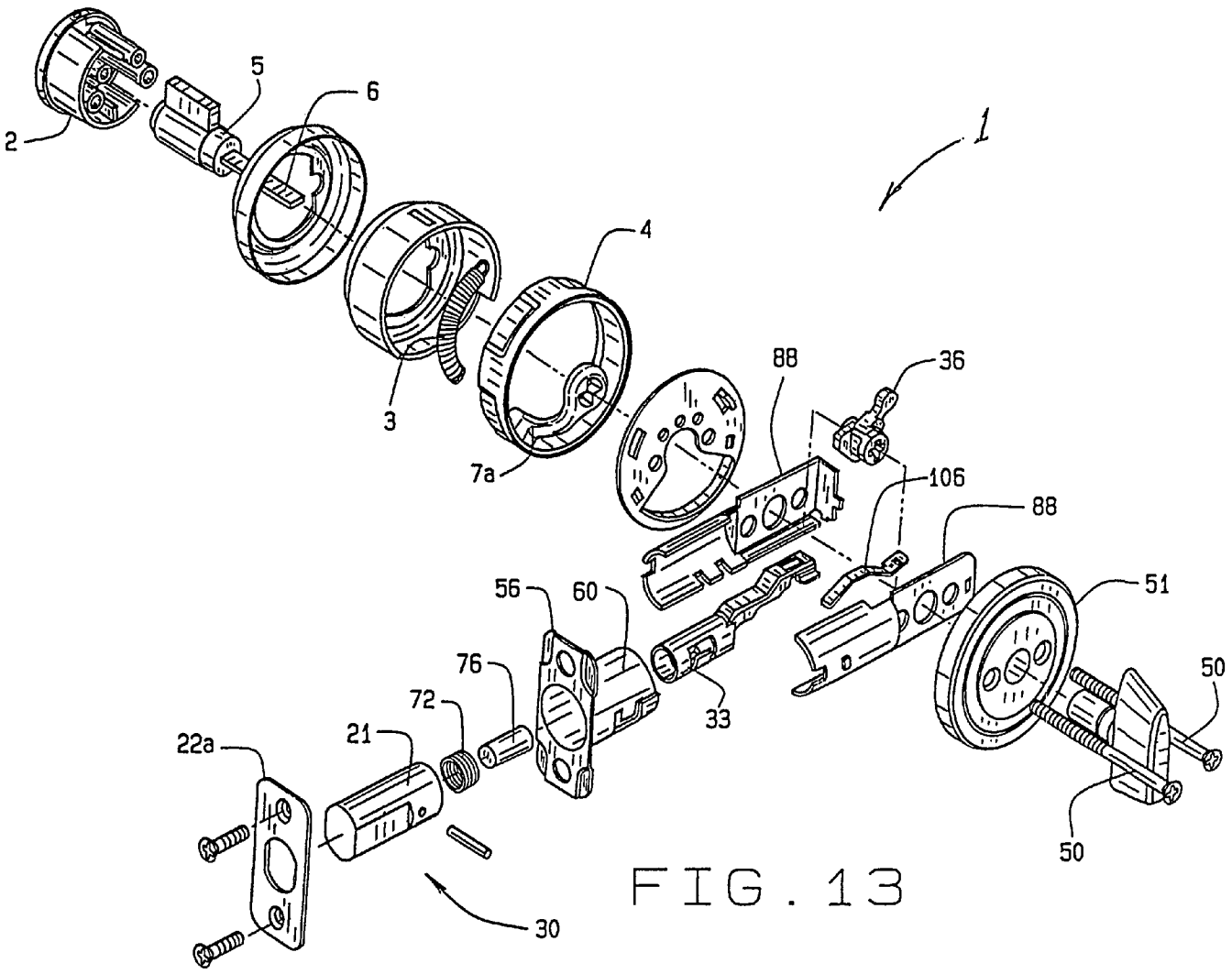
FIG. 13 shows an exploded view of the entire keyless deadbolt lock assembly, but incorporating the type of cast actuator ring of FIG. 12.

FIG. 13 provides a view similar to FIG. 11, of the entire assembly, but incorporating the locking ring 4, as previously reviewed with respect to the embodiments as shown in FIGS. 10 and 12.

As previously reviewed, it is just as likely that the entire assembly for the centering of the key locking cylinder, and the actuator assembly, when operating upon the latch mechanism, could just as easily be fabricated to function upon turning of the locking ring from a counterclockwise direction of turn. This would only necessitate the rearrangement of the spring means, in an opposite arcuate configuration, to allow the latch to force the deadbolt into its extended and locking position, and then provide for the reverse turn of the locking ring to its steady state position, without affecting the deadbolt locking of the door in place, once manipulated. This can just as easily be achieved from the components of this invention, to once again allow for the latching of the deadbolt for locking of the door in which it is installed, whether it is located on a right hand door, or a left hand door, upon its installation, in the manner as previously reviewed herein.

With previous designs for keyless deadbolt lock assemblies, because all of these previous locks did not give consideration to the centering of all of the operative components for the locking assembly, the user had several very cumbersome steps to substantially take the lock body and its parts apart, and put them all back together in a different configuration, before starting the installation process on the door. And, since the cylinder locking mechanisms and its torque blade were not centered within the lock structure, in all instances, it would not be possible to shift the latch from one side, to the other, depending upon whether a right hand or left hand installed door was being assembled. Depending upon the installation of the keyless locking deadbolt for an "in swing" or "out swing" left hand door or right hand door; one will have four different configurations to figure out. To further cause confusion and improper locking operations, the installer previously needed to properly follow several different directions for installation. The need to remove the reconfiguration screw, to turn a ring to the correct configuration depending upon the installation, to turn the actuator to the proper position, followed by lining up the turning ring perfectly over the turntable hole below, and reinstalling the reconfigured screw through the ring and into the turntable hole, was a very complex process. If the reconfiguration process is not done with total precession, the user will have a lock that could bind or fail completely, making it impossible to use the unit, or configured to unlock the door when turning the ring.

There is a further confusion with the usage of the prior art devices regarding which way to turn the ring to lock the door. If the user does not keep this in mind, with each and every time the user locks the door, one can easily think that the lock on the door is secured, when it is not. For example, if the front door is a left hand door, and the side door of a building is a right hand door, the user must remember what direction to turn the ring on each door to lock the door, with the prior type of assemblies. Depending upon the four possible configurations, the user installs the keyless deadbolt, and then needs to remember which way to turn the ring, to lock the door, when leaving their homes or their office. The user will be confused as to which direction to turn the locking ring, whether to the right, or to the left. The cause of the design in previous disclosures require a substantial need of reconfiguration of all previous keyless locking deadbolt devices, depended upon the use of the longstanding traditional offset lower cylinder deadbolt latch, which was just not center located within the structure, but allowed for a simple reassembly of the current invention, into the door, only requiring a clockwise turn for locking the deadbolt, regardless whether the lock assembly is applied to a right hand door, or a left hand door, in its assembly. There really was no way with the prior devices to achieve universality of application, and usage, as can be done with the current invention, due to the precise centering of all of its operating components, including its key cylinder, within the structure of the locking assembly, which accommodates a mere pivot to its latch assembly, to achieve either left hand operation, or right hand operation, for locking a door in place. This current invention adds symmetry to the assembly, installation, and usage of this unidirectional deadbolt concept, primarily due to the location of the centered arranged configuration of all of its operative components, which allows its latch to be shifted, depending upon the type of door installation sought.

The essence of the invention is that there is no required disassembly or no reconfiguration required with the deadbolt door lock assembly of this invention, unlike what had to be done with the prior art structures. One need only to reorient the deadbolt latch, by pivoting it 180°, when the same deadbolt and deadbolt latch is used for hanging either a right hand door, or a left hand hung door, when using this invention.

Another primary advantage of this invention, as previously referred to, is that the deadbolt lock, with its centered key lock cylinder, will remain in its usual position upon the door when the lock is used either on a left hand hung door or a right hand hung door. The only item reversed, 180° , is the latch bolt assembly 30. Thus, the various pins of the cylinder lock 19 remain upwardly within the cylinder, and therefore, no water can leak into the door lock, at this location, and corrode those operative pins, with which the lock key functions, to provide for an unlocking of the deadbolt, when access through the door is required. In other words, the various key pins remain in the upper portion of the cylinder lock, and since the cylinder lock and it s deadbolt lock are never pivoted or reversed, this enhances the useful life of the door lock, for a prolonged period of time. When the dead bolt lock is reversed for use upon one or the other of a right hand or left hand hung door, only the latch mechanism 30, as shown in FIGS. 7, 8A, and 8B, gets reversed, but the lock face plate 2, its locking ring 4, its locator 10*a* , and all of its components, as shown in FIG. 1, and as disclosed in FIGS. 2-6, remain in their same upright position, as shown therein, and does not get turned upside-down when the lock is used either for a right hand or left hand hung door.

Figure 14:
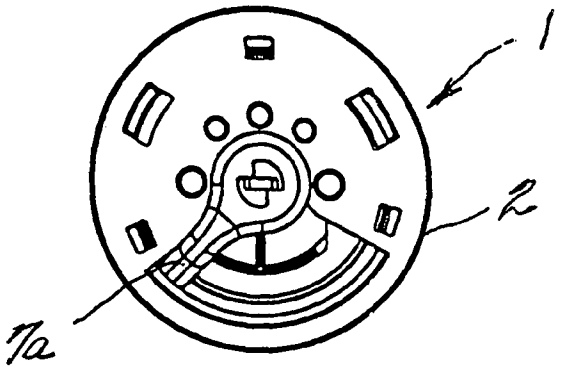
FIG. 14 is a view of the resurface of the keyless deadbolt lock assembly in its steady state condition.
Figure 16:
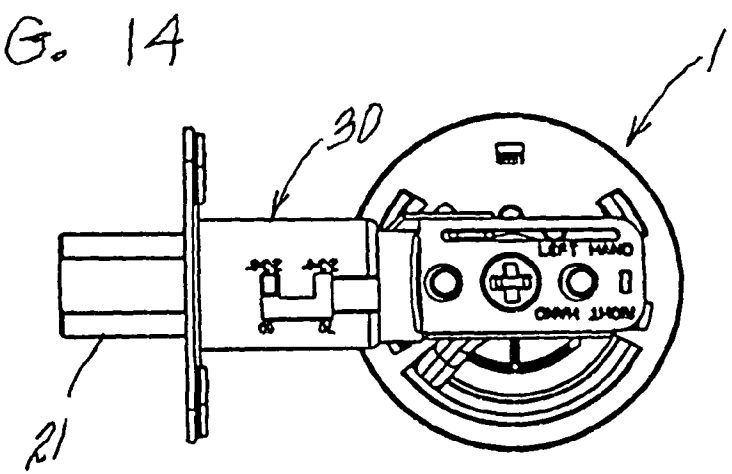
FIG. 16 is a view of the resurface of the keyless deadbolt lock assembly and its deadbolt latch set up for a left hand door installation.
Figure 15:
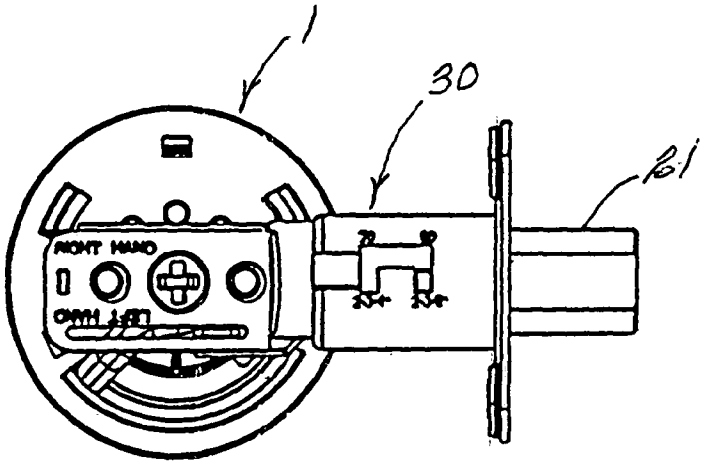
FIG. 15 is a rear view of the keyless deadbolt lock assembly and its deadbolt latch set up for a right hand door installation.

FIG. 14 shows a rear view of the one piece locking ring and actuator of the lock assembly 1 of this invention. It shows its external plate 2 and the actuator 7*a* that is integrally formed with its ring, generally as can be seen in FIG. 10 of the drawings. As noted in FIG. 15, the deadbolt 21 and its latch bolt assembly 30 are set up for installation upon a right hand hung door, or for installation upon the right edge of the door, in preparation for its usage for that purpose. And, FIG. 16 shows the latch bolt assembly 30 and its associated deadbolt 21 in preparation for installation upon the left edge of a door, for its installation for usage. As previously stated, the only component that is reversed is the deadbolt and latch bolt assembly 30, relative to the center key lock cylinder as previously identified at 19, which requires no internal reconfiguration of any of the components of this uni-directional single action center cylindrical key less deadbolt lock assembly, when applied for either right or left hand hung doors, for operation. The key cylinder 5 and the locking ring 4 and torque blade 6 are never changed in their upright setting, as can be seen.

Since the prior art devices do not have a centered key cylinder, obviously, they can not be simply reversed upon the door, for right hand or left hand operation, since the latch assembly will require a completely different reconfiguration, due to the off set positioning of its key latch cylinder, as can be noted from their structured door locks.

As previously reviewed, all existing deadbolts have a vertically off centered axis from the top down, whereas, the key cylinder lock 19 of the current invention is fully centered both upon a vertical and horizontal axis, of the key cylinder, the latch bolt assembly, and the deadbolt. The prior art does not have this configuration. You can not use the one piece ring and actuator of the current invention for any of the prior art style of key locks, because they are off centered vertically, whereas, with the current invention, the ring and its actuator can be used either for a left hand or right hand hung door installations, without reconfiguration or binding. The prior art would require a two part type of the ring and actuator, that would further require total reconfiguration when its door latch is positioned from a right hand hung door, to a left hand hung door for operation. Thus, with prior locks, there must be a partial disassembly and total reconfiguration of the assembly, to make it work upon both edges of the hung door. This becomes quite obvious upon review of the prior U.S. Pat. No. 5,813,261, because its key center aperture 66 is below the center of its tumbler assembly 12, are vertically off set, as can be noted. You just can not reverse that lock assembly, and deadbolt, without a total reconfiguration and reassembly of its lock and deadbolt, as can be noted.

As previously explained, the deadbolt must be installed in the upright position with the cylinder pins and springs in the upright position for proper and correct installation, and usage. The cylinder pins and springs for the cylinder key way must be in the upright position to protect the pins and springs from the elements of weather, water, dust, debris, that will enter this cylinder key way at the bottom. Turning the deadbolt upside down will cause failure of the cylinder with any foreign material and rust that enters therein, and attains access to the key way, and its keys, that will cause a failure of the deadbolt to work.

The benefits of this new design is that it simplifies the key less locking deadbolt where there is no need for any reconfiguration of the deadbolt before installation, regardless what side of the door it is applied. This device also eliminates the need to turn the key less locking ring clockwise and counterclockwise, to lock the deadbolt based on the door being either a left hand, right hand, in-swing or out-swing entry door. This device, because none of its components need to be reconfigured, eliminates the possibility of binding of the two part type of ring and actuator, as known in the prior art, particulars when applied to either a right hand or a left hand hung door. These where the improvements provided by the claimed subject matter of this invention.

Variations or modifications to the subject matter of this invention may be contemplated by those skilled in the art upon review of the invention as described herein. Such variations, if within the spirit of this invention, are intended to be encompassed within the scope of any claims to patent protection issuing hereon. The depiction of the invention in the drawings, and its description in the preferred embodiment, are set forth for illustrative purposes only.

I claim:

1. A door lock assembly incorporating a deadbolt and latch bolt assembly for incorporation in a door and having a uni-directional operative centered key cylinder for pivotal functioning for keyless operation of said deadbolt from an unlocked position to a locked position of said deadbolt, said door lock assembly comprising:

a key cylinder provided fully centered in said door lock assembly, said key cylinder being both vertically and horizontally aligned on a center axis in said door lock assembly, a key cylinder torque blade extending from said key cylinder and aligned on said center axis;

an actuator interlock mechanism operatively connected in the door lock assembly and provided for pivoting with said torque blade on said same center axis, said actuator interlock mechanism being pivotal on said center axis from an unlocked position corresponding to an unlocked position of the deadbolt, to a locked position corresponding to a locked position of said deadbolt, said pivotal locking movement of said actuator interlock mechanism being made in one direction, regardless whether the door lock assembly and its said actuator interlock mechanism is installed for a right hand or left hand hung door;

a ring pivotally mounted upon the door lock assembly and pivotal with the actuator interlock mechanism from an initial position of said ring to a second position thereof;

said actuator interlock mechanism and ring being integrally structured as one piece for simultaneous pivot during actuation;

said actuator interlock mechanism integrally connected to said ring for conjoint pivot therewith, said actuator interlock mechanism being configured and arranged for contact with said torque blade when the door lock assembly is in an unlocked position and upon rotation of the ring from its initial position, and turning in pivotal movement to pivot the torque blade from an unlocked position of the actuator interlock mechanism and its associated latch bolt assembly and deadbolt to a locked position of said latch bolt assembly, and a biasing member interconnecting with the door lock assembly and said actuator interlock mechanism to urge the actuator interlock mechanism to pivot in reverse from its pressured contact with the torque blade after securing the locked position of the latch bolt assembly and its deadbolt, on either a right hand or left hand hung door;

said latch bolt assembly being operable upon a turning of the ring in a pivotal mode in one direction, and the ring being rotatable only in said pivotal direction to rotate the integral actuator interlock mechanism and ring, and said torque blade from its unlocking position of the deadbolt to its locking position in its manipulation of the latch bolt assembly and its deadbolt for locking of the associated door;

said latch bolt assembly being configured for installation upon either a right hand or left hand hung door with no reconfiguration of said latch bolt assembly required, said latch bolt assembly may be reversed by inverting in its installation upon a door to urge its deadbolt to lock either a right hand or left hand hung door, said latch bolt assembly incorporating a deadbolt cylindrical frame, a latch driving mechanism, said latch driving mechanism having an opening therethrough and through which said torque blade extends, and a latch operator for movement of the deadbolt during its shifting into a locked or unlocked position, the back of said cylindrical frame having a pair of apertures therein, said cylindrical frame, having upper and lower edges and the pair of apertures being arranged centrally between said upper and lower edges of the back of said cylindrical frame, the pair of apertures provided for mounting for pivotal movement of said latch driving mechanism therein, said torque blade of said door lock assembly extending through said latch driving mechanism, the apertures at the back of said cylindrical frame and the opening through the latch driving mechanism being on the same center axis as the key cylinder and said torque blade, such that when the ring is manually pivoted, causes pivoting of the torque blade and the actuator interlock mechanism, the latch bolt assembly will force the deadbolt into a locked position, regardless whether provided upon a right hand or left hand hung door because of its fully centered location of the key cylinder.

2. The door lock assembly of claim 1, wherein the ring positions the deadbolt from an unlocked position to a locked position upon a pivotal movement in a clockwise direction.

3. The door lock assembly of claim 2, wherein the latch bolt assembly is operable in only said clockwise pivotal movement without further adjustment other than being inverted, regardless whether the door is hung for right hand or left hand operation through functioning of the door lock assembly.

4. The door lock assembly of claim 1 wherein the same latch bolt assembly may be configured for installation upon either a right hand or left hand hung door with no reconfiguration of its latch bolt assembly required.

5. The door lock assembly of claim 4 wherein the deadbolt and latch bolt assembly will be inverted in its installation within the lock assembly to function as a deadbolt for locking either the right hand to a left hand hung door.

6. The door lock assembly of claim 5 wherein said door lock assembly having said key cylinder, and said key cylinder is positioned in the center of the door lock assembly to provide for the keyless deadbolt locking when applied to either a right hand or left hand hung door.

7. The door lock assembly of claim 1 wherein said actuator interlock mechanism connecting with the latch bolt assembly, said center axis torque blade extending through the actuator interlock mechanism and the latch bolt assembly, said actuator interlock mechanism securing said torque blade therethrough, and said ring and actuator interlock mechanism being spring biased to allow the ring to be rotated in a first direction, to lock the deadbolt and door, and with said spring bias returning the ring and actuator interlock mechanism to its initial inactive position.

8. The door lock assembly of claim 7 wherein said lock assembly is operable in a clockwise operating mode.

9. The door lock assembly of claim 7 wherein said actuator interlock mechanism is configured for an operating mode to move the deadbolt assembly and latch bolt assembly in one direction of rotation of said ring regardless whether the door lock assembly is mounted to a right hand or left hand hung door.

10. The door lock assembly of claim 9 wherein said actuator interlock mechanism is secured with the ring to permit rotation of the ring in a clockwise direction to urge the actuator interlock mechanism to force the deadbolt into its locking position, and to return the ring to its inoperative position.

11. The door lock assembly of claim 10 wherein the initial position of the actuator interlock mechanism and its connected ring may be forced into its operating mode by turning it in a clockwise direction.

12. A deadbolt and latch bolt assembly operatively associated within a door lock assembly for uni-directional operatively centered key cylinder for pivotal functioning for keyless operation of said deadbolt from an unlocked position to a locked position of said deadbolt, for either a right hand or left hand hung door, said door lock assembly comprising:

a deadbolt, a latch bolt assembly for moving said deadbolt between locked and unlocked positions;

a key cylinder provided fully centered in said door lock assembly, said key cylinder being aligned on a center axis in said door lock assembly, a key cylinder torque blade extending from said key cylinder and extending and aligned on said center axis;

an actuator interlock mechanism operatively connected to the door lock assembly and provided for pivoting said torque blade on said same center axis, said actuator interlock mechanism being pivotal on said center axis from an unlocked position corresponding to an unlocked position of the deadbolt, to a locked position corresponding to a locked position of said deadbolt, said pivotal locking movement of said actuator interlock mechanism being made in one direction, regardless whether the door lock assembly is installed for a right hand or left hand hung door;

a ring included with the actuator interlock mechanism and pivotally mounted upon the door lock assembly and pivotal with the actuator interlock mechanism from an initial position of said ring to a second position thereof;

said actuator interlock mechanism and ring being integrally structured as one piece for simultaneous pivot during actuation;

said actuator interlock mechanism being configured and arranged for contact with said torque blade from an unlocked position and upon pivot of said ring from its initial position, turning said torque blade from an unlocked position of the actuator interlock mechanism and its associated latch bolt assembly and deadbolt to a locked position, and a biasing member interconnecting between the door lock assembly and the actuator interlock mechanism to urge the actuator interlock mechanism to pivot in reverse while leaving the torque blade and deadbolt in the locked positioned, on either a right hand or left hand door;

said latch bolt assembly being operable upon a turning of the ring in a pivotal mode in one direction, and the ring being rotatable only in said pivotal direction to rotate the integral actuator interlock mechanism and pivotal torque blade from its unlocking position of the deadbolt to its locking position in its movement of the latch bolt assembly and its deadbolt in locking of the associate door;

wherein said actuator interlock mechanism has a radially inwardly extending arm integrally structured to said ring and said arm having an opening on the said center axis to accept said torque blade therethrough, so that both said ring and actuator arm will simultaneously turn upon pivot of the ring to provide for pivotal actuation of the torque blade and the keyless locking of the door lock assembly during usage;

said latch bolt assembly being configured for installation upon either a right hand or left hand hung door with no reconfiguration of its parts required, said latch bolt assembly may be inverted in its installation upon a door without reconfiguration to urge its deadbolt to lock either a right hand or left hand hung door, said latch bolt assembly incorporating a cylindrical deadbolt frame, a latch driving mechanism, and a latch operator for movement of the deadbolt during its shifting into a locked or unlocked position, the back of said cylindrical frame having a pair of apertures therein, the pair of apertures provided for mounting for pivotal movement of said latch driving mechanism therein, said torque blade extending through said latch driving mechanism, the apertures of the cylindrical frame and an opening through said latch driving mechanism being on the same center axis as the key cylinder and said torque blade, such that when the ring is pivoted, causes pivoting of the actuator interlock mechanism and shifting of the latch bolt assembly that forces the deadbolt into a locked position.

13. The deadbolt and latch bolt assembly of claim 12 wherein said actuator interlock mechanism is operable in only a clockwise pivotal movement, regardless whether the door is hung for a right hand or left hand operation.

14. The deadbolt and latch bolt assembly of claim 12 wherein the actuator interlock mechanism is operable in only a counterclockwise pivotal movement without further adjustment, regardless whether the door is hung for a right hand or left hand operation.

15. A deadbolt and latch bolt assembly operatively associated within a door lock assembly and having an operable centered key cylinder for uni-directional pivotal functioning for keyless operation of said deadbolt from an unlocked position to a locked position of said door lock assembly and for use with either a right hand or left hand hung door, said door lock assembly comprising:

a deadbolt, a latch bolt assembly operatively connected to said deadbolt for moving said deadbolt between an unlocked position to a locked position:

a key cylinder provided fully centered on a center axis of said door lock assembly, a key cylinder torque blade extending internally from said key cylinder and aligned on said fully centered axis;

a ring, an actuator interlock mechanism integrally formed as one piece with said ring and extending inwardly thereof, said ring and said actuator interlock mechanism pivotally mounted upon said door lock assembly and pivotal from an initial position of said ring to a second position thereof locking said deadbolt;

said actuator interlock mechanism being formed as one piece with said ring and extending towards the center of said ring and having an interlock mechanism at its innermost end located on said center axis and through which said centered torque blade extends, said actuator interlock mechanism capable of engaging said torque blade upon turning of its integral ring to move said deadbolt into a locked position;

a biasing member interconnecting between the door lock assembly and the actuator interlock mechanism to urge the said ring and actuator interlock mechanism to pivot in reverse while leaving the torque blade and deadbolt in a locked position, on either a right hand or left hand hung door;

said latch bolt assembly being operable upon a turning of the ring in a pivotal mode in one direction; and said latch bolt assembly being configured for installation on either a right hand or left hand hung door with no reconfiguration of its parts required, said latch bolt assembly incorporating a cylindrical deadbolt frame, a latch driving mechanism, and a latch operator for movement of the deadbolt during its shifting into a locked or unlocked position, the back of said cylindrical frame having a pair of apertures therein, said pair of apertures provided for mounting for pivotal movement of said latch driving mechanism therein, said torque blade extending through said latch driving mechanism and the apertures being on the same center axis of the key cylinder and said torque blade, said latch bolt assembly having an axis that perpendicularly intersects the center axis of the key cylinder that is fully centered in said door lock assembly.

* * * * *